US006491171B2

(12) United States Patent
Maier-Hunke

(10) Patent No.: US 6,491,171 B2
(45) **Date of Patent: *Dec. 10, 2002**

(54) SUPPORTING STAND FOR SWIVEL ELEMENTS

(75) Inventor: Horst-Werner Maier-Hunke, Iserlohn (DE)

(73) Assignee: "Durable" Hunke & Jochheim GmbH & Co., KG, Iserlohn (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 23 days.

(21) Appl. No.: 09/341,331

(22) PCT Filed: Jan. 23, 1998

(86) PCT No.: PCT/DE98/00284

§ 371 (c)(1),
(2), (4) Date: Jul. 7, 1999

(87) PCT Pub. No.: WO98/33161

PCT Pub. Date: Jul. 30, 1998

(65) Prior Publication Data

US 2001/0054594 A1 Dec. 27, 2001

(30) Foreign Application Priority Data

Jan. 24, 1997 (DE) ..... 197 03 754

(51) Int. Cl.[7] ..... A47F 7/16

(52) U.S. Cl. ..... 211/47; 248/460; 211/169

(58) Field of Search ..... 211/47–48, 42, 211/168–169, 80–81, 133.1; 248/441.1, 460, 463, 465, 163.1, 165

(56) References Cited

U.S. PATENT DOCUMENTS

| | | | | | |
|---|---|---|---|---|---|
| 2,693,655 | A | * | 11/1954 | Tschiedel | 248/460 |
| 2,759,454 | A | * | 8/1956 | Swart | 248/441.1 |
| 2,829,651 | A | * | 4/1958 | Loring | 248/460 |
| 3,330,524 | A | * | 7/1967 | Foley | 248/441.1 |
| 4,771,977 | A | * | 9/1988 | Larson | 248/460 |
| 4,830,318 | A | * | 5/1989 | O'Brien | 248/165 |
| 5,305,114 | A | * | 4/1994 | Egashira et al. | 248/460 |
| 5,542,640 | A | * | 8/1996 | Tarozzi | 248/460 |
| 5,580,024 | A | * | 12/1996 | Briee | 248/460 |
| 5,833,082 | A | * | 11/1998 | Barthel | 211/47 |
| 5,967,483 | A | * | 10/1999 | Liberfarb et al. | 248/441.1 |
| 6,234,707 | B1 | * | 5/2001 | Maier-Hunke | 403/331 |

FOREIGN PATENT DOCUMENTS

| | | |
|---|---|---|
| CH | 685367 | 6/1995 |
| GB | 2268822 | 1/1994 |

* cited by examiner

*Primary Examiner*—Daniel P. Stodola
*Assistant Examiner*—Jennifer E. Novosad
(74) *Attorney, Agent, or Firm*—Mark P. Stone

(57) ABSTRACT

Display panel systems make it possible to access a wide range of information. Such systems have a stand and a support for swivel panels upon which information carriers can be placed. The stand is modular and has two side parts which can be combined with a variable number of intermediate parts, each of which has a support for swivel panels.

28 Claims, 4 Drawing Sheets

SUPPORTING STAND FOR SWIVEL ELEMENTS

TECHNICAL FIELD

The invention relates to a stand for supports of swivel panels, swivel pockets, swivel sleeves or the like.

PRIOR ART

A stand of the abovementioned type which comprises an angled sheet-metal plate and of which the legs form an angle of less than 90° is known (DURABLE, Catalogue 950, page 109). The shorter of the two legs forms the foot of the stand, while the longer leg is provided, at its top and bottom ends, with fittings having pivot bearings for the swivel panels or the like. The width of the sheet-metal plate and the number of fittings depends on the number of swivel panels which are to be accommodated in each case.

Another known stand comprises a cast foot to which a comparatively short leg of an angled sheet-metal plate is screwed (DURABLE, Catalogue 950, page 109). The larger of the two legs is also provided in this case, in turn, with fittings having pivot bearings.

In both the cases described, the number of swivel panels determines the dimensions of the stand or of the parts forming the stand. In practice, this means that the outlay for producing the stands and for storing the same is undesirably high.

DESCRIPTION OF THE INVENTION

The object of the invention is to provide a stand of the type in question which is constructed in the manner of a modular system and allows its accommodating capacity to be changed cost-effectively. This object is achieved by a stand which is characterized according to the invention in that it comprises two side parts and at least one intermediate part connected to said side parts in a releasable manner, each intermediate part being assigned in each case one support.

The stand according to the invention provides the advantage that its width can easily be varied by the use of a greater or lesser number of intermediate parts and can thus be adapted to the number of swivel panels or the like which are to be accommodated.

It has proven particularly advantageous in this case if the intermediate parts are configured such that they are suitable for accommodating supports which can also be used as wall-mounted supports.

Further details and features of the invention can be gathered from the subclaims and from the following description of a particularly advantageous embodiment of the invention illustrated in the attached drawing.

METHODS OF IMPLEMENTING THE INVENTION

Figure 1:
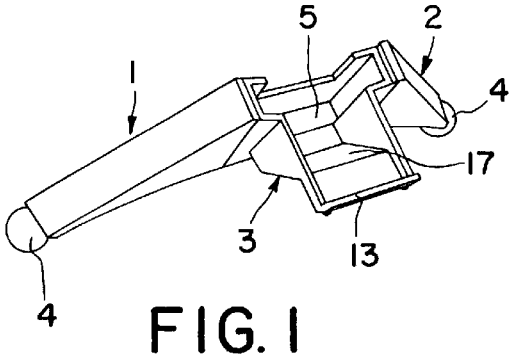
FIG. 1 shows a stand comprising an intermediate part and two side parts in the perspective view as seen obliquely from the front.
Figure 3:
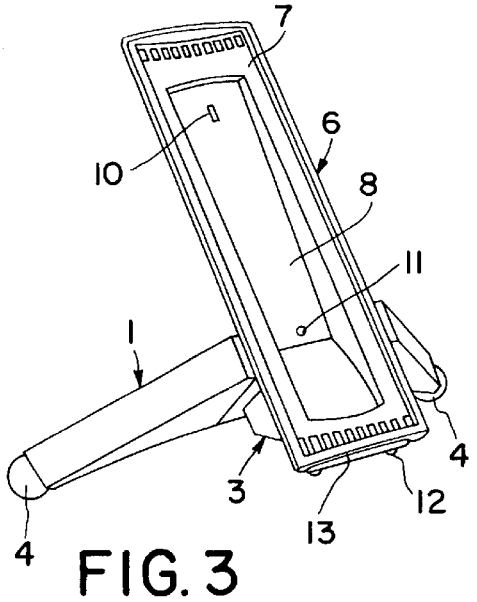
FIG. 3 shows a front view, corresponding to FIG. 1, of the stand according to FIGS. 1 and 2 provided with a support.
Figure 2:
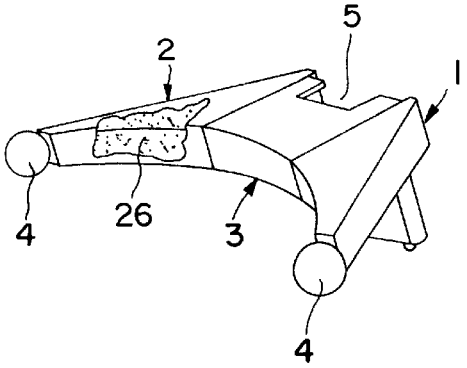
FIG. 2 shows the stand according to FIG. 1 in the perspective view as seen obliquely from the rear.
Figure 4:
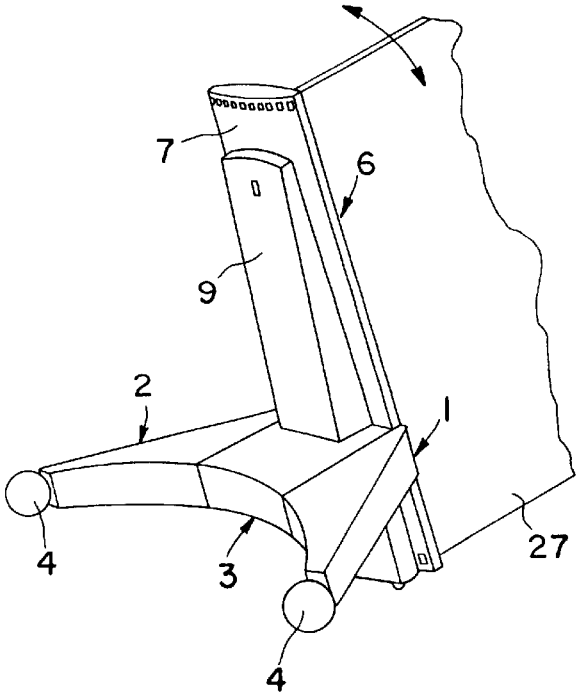
FIG. 4 shows a rear view, corresponding to FIG. 2, of the stand according to FIGS. 1 and 2 provided with a support.

The stand which is illustrated in FIGS. 1 and 2 comprises two side parts 1 and 2 and an intermediate part 3, it being the case that the side parts 1 and 2, which are usually provided with lead or some other weighting inserts, correspond to one another completely in terms of their shape and size. Both the side parts 1 and 2 and the intermediate parts 3 are designed as plastic injection mouldings. Fastened at the free ends of the side parts 1 and 2 are supporting balls 4 which consist of rubber or a similar material which counteracts slipping movements. The side parts 1 and 2 can be provided with weighting inserts 26, and FIG. 2 illustrates one weighting insert in side part 2. The intermediate part 3 has a means 5 for accommodating a support 6. The support 6 is likewise a plastic injection moulding; it has a shell-like basic body 7 with a central hollow trough shaped section 8, of which the rear wall 9 has a slot 10 and a bore 11 in order for it to be possible to use the support 6 as a wall-mounted support as required. Details of the construction of the support 6 are described in German Patent Application 196 23 904.4-26. As can be seen from FIGS. 3 and 4, the bottom section of the hollow 8 fits into the accommodating means 5, the bottom border 12 of the support 6 being supported on a transverse web 13 of the intermediate part 3. Swivel elements, as for example swivel panels, swivel pockets, or swivel sleeves, are generally designated by reference numeral 27 in FIG. 4.

Figure 5:
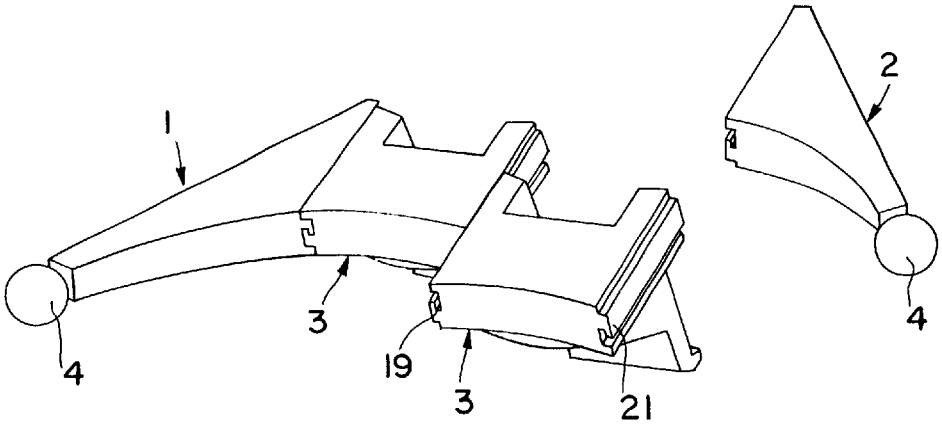
FIG. 5 shows the accommodating capacity of the stand according to FIGS. 1 and 2 being enlarged by an additional intermediate part.
Figure 6:
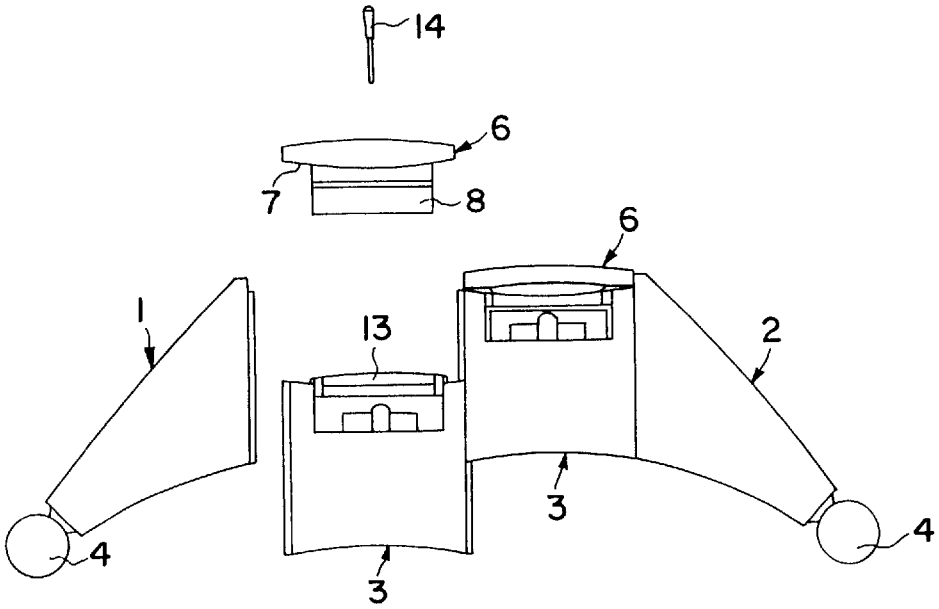
FIG. 6 shows the connection of an intermediate part to in each case one support.
Figure 7:
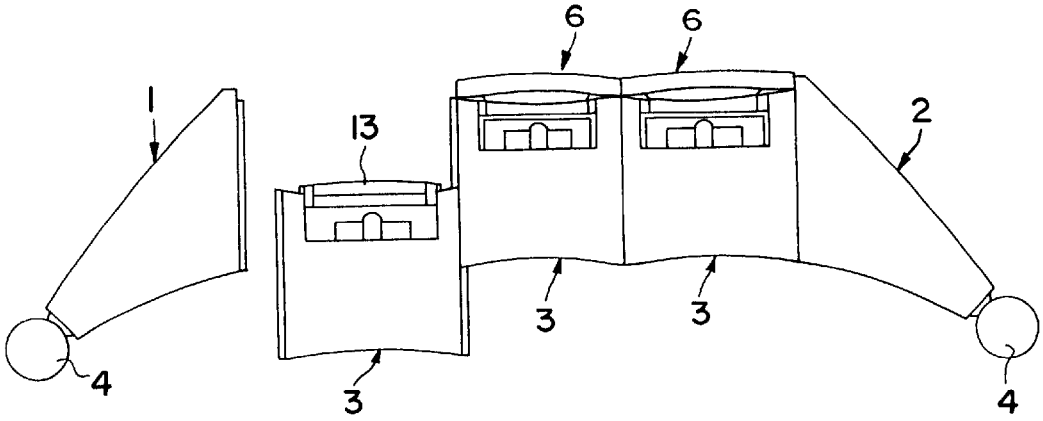
FIG. 7 shows a stand with three times the accommodation capacity of the stand according to FIGS. 1 and 2.
Figure 8:
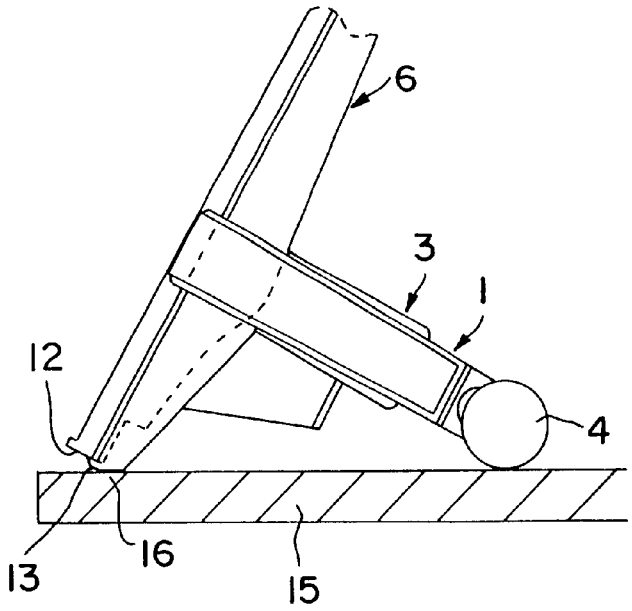
FIG. 8 shows the position of a stand supported on a table top.
Figure 9:
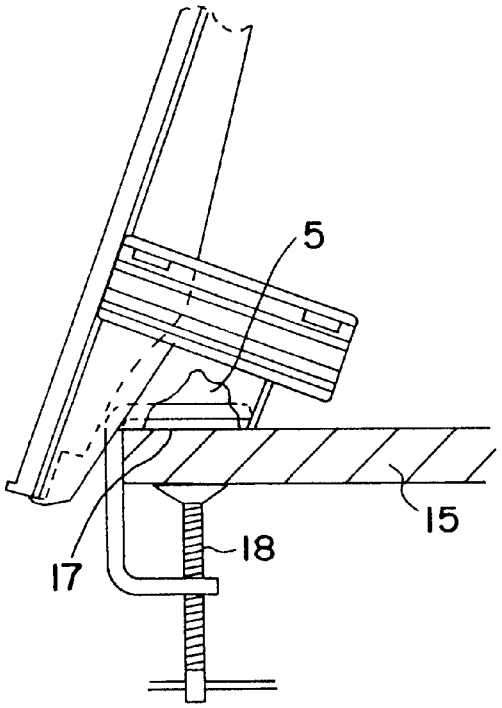
FIG. 9 shows the possibility of directly fastening an intermediate part on the border of a table top by means of a clamp.
Figure 10:
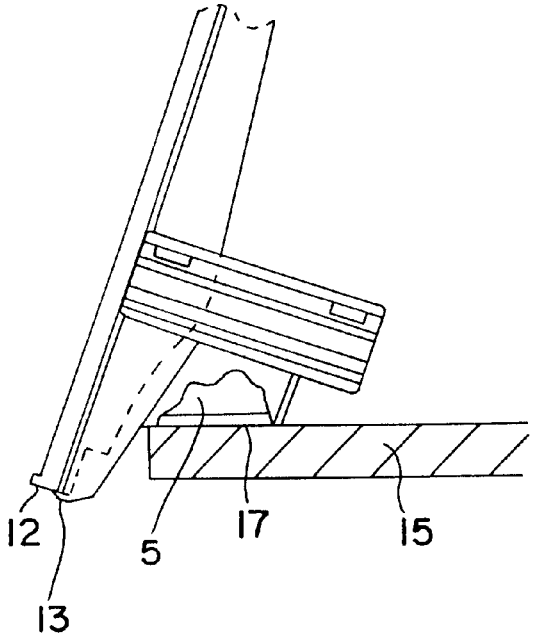
FIG. 10 shows an intermediate part screwed onto a table top.
Figure 12A:
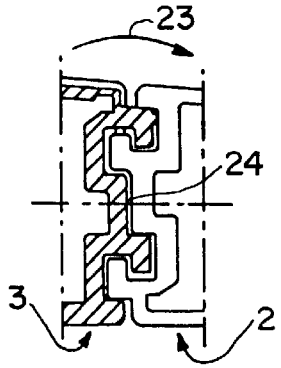
FIG. 12*a* shows a plug-in connection between a side part and an intermediate part in accordance with one aspect of the stand of the present invention.
Figure 12B:
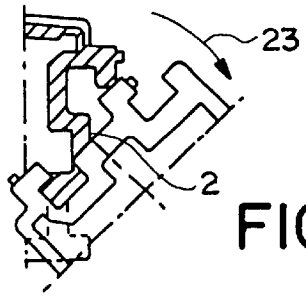
FIG. 12*b* shows the position of the side part of FIG. 12*a* pivoted into an acute angle relative to the intermediate part of FIG. 12*a*.
Figure 12C:
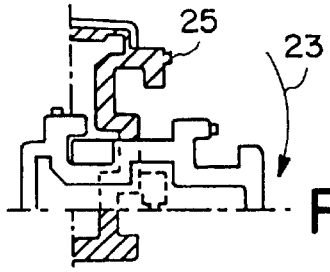
FIG. 12*c* shows the position of the side part of FIG. 12*a* pivoted into a right angle relative to the intermediate part of FIG. 12*a*.
Figure 12D:
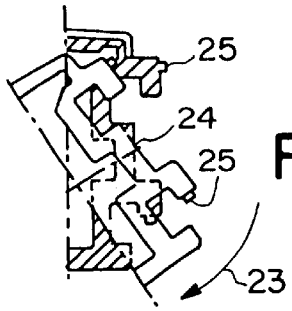
FIG. 12*d* shows the position of the side part of FIG. 12*a* pivoted into an obtuse angle relative to the intermediate part of FIG. 12*a*.
Figure 12E:
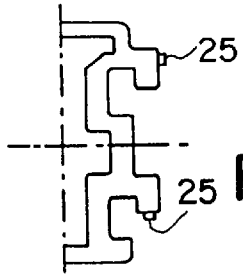
FIG. 12*e* shows the position of the side part of FIG. 12*a* pivoted 180° relative to the intermediate part of FIG. 12*a*.

As can be seen from FIGS. 5 to 7, the number of intermediate parts 3 can be easily varied in accordance with the requirements in each case. More or less wide stands can be produced using just two different components, it being possible for a support 6 to be connected to each intermediate part 3 with the aid of in each case one screw 14. The stand is supported on an underlying surface 15, formed by a table top for example, via the front bottom border 16 of the intermediate part 3, in all cases, and via the supporting balls 4, as shown in FIG. 8. Expedient shaping of the means 5 for accommodating the intermediate part 3 makes it possible for the latter, without the side parts 1 and 2, to be fastened directly, e.g. on the border of the underlying surface 15. For this purpose, the accommodating means 5 has a flat base 17 which either can be fastened on the underlying surface 15 with the aid of a screw clamp 18—as is shown in FIG. 9—or else can be screwed to said underlying surface 15—as is illustrated in FIG. 10.

Figure 11:
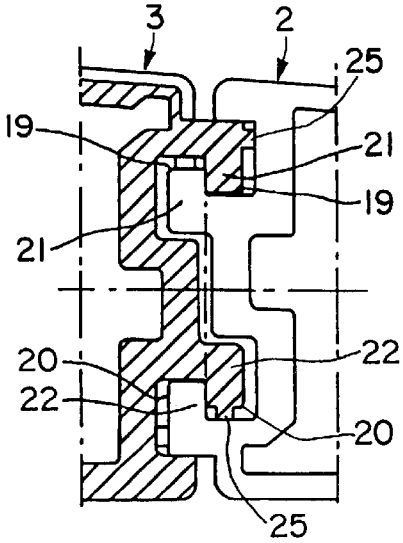
FIG. 11 shows a detail of the plug-in connection of the parts illustrated in FIGS. 1 and 2.

The side parts 1, 2 and the intermediate parts 3 are coupled to one another by a plug-in connection comprising grooves and webs. A particularly stable plug-in connection is illustrated in FIGS. 11 and 12; it comprises in each case two grooves 19 and 20 and two webs 21, 22. In order for it to be possible to manage with just two differently shaped components, namely an intermediate-part type of component and a side-part type of component, the grooves 19, 20 and webs 21, 22 of the parts which are to be connected to one another are shaped such that their contours cover over one another or overlap if—as is shown in FIG. 12—the grooves 19, 20 and webs 21, 22, for example, of the right-hand side part 2 are pivoted, in the direction of the arrow 23, through 180° about an axis 24, located between the parts 2, 3 and running parallel to the grooves 19, 20 and webs 21, 22. The webs 21, 22 are guided in a form-fitting manner in the grooves 19, 20. In order to ensure that the parts are held together securely, it is recommended for the webs 21, 22 of the plug-in connections to be provided with braking or latching protrusions 25. Preferably, each intermediate part 3 has at least one groove 19, 20 and at least one web 21, 22 on each of its two opposed sides, and each side part 1, 2 has at least one groove 19, 20 and at least one web 21, 22 on only one of its two opposed sides.

What is claimed is:

1. A stand system comprising a support and at least one swivel panel, swivel pocket, or swivel sleeve; said at least one swivel panel, swivel pocket, or swivel sleeve being removably and releasably mountable to said support for pivotable movement relative to said support, wherein the stand system further comprises two side parts (1, 2) and at least one intermediate part (3), said at least one intermediate part (3) being releasably connected to said support (6), said at least one intermediate part (3) being disposed between said two side parts (1, 2) and having opposed sides and a connecting structure on each of said opposed sides for selectively and releasably coupling said at least one intermediate part to at least one of said two side parts.

2. A stand system according to claim 1, characterized in that each of the side parts (1, 2) is connectable to said at least one said intermediate part (3) by a plug-in connection provided by said connecting structure.

3. A stand system according to claim 2, characterized in that each said plug-in connection is formed by at least one pair of grooves (19, 20) and webs (21, 22) on said opposed sides of said at least one intermediate part (3) and on one edge surface of each said side part.

4. A stand system according to claim 3, characterized in that the webs (21, 22) of each said plug-in connection are provided with at least one braking or latching protrusion (25).

5. A stand system according to claim 3, characterized in that each said plug-in connection comprises at least two grooves (19, 20) and at least two webs (21, 22) on at least one side of each said part to be connected together, and in that the grooves (19, 20) and the webs (21, 22) guided in a form-fitting manner therein, of the parts which are to be connected, are coordinated with one another in contour such that, in the case of a pivoting operation of one of said parts to be connected through 180° about an axis (24) located between said parts to be connected and oriented parallel to the grooves (19, 20) and the webs (21, 22), said grooves and said webs being movable into a congruent position.

6. A stand system according to claim 3, characterized in that a front bottom border (16) of said at least one intermediate part (3) and ends of the side parts (1, 2) which are rearwardly offset relative to said front bottom border (16) of said at least one intermediate part (3) support said stand on an underlying surface (5).

7. A stand system according to claim 2, characterized in that each said plug-in connection comprises at least two grooves (19, 20) and at least two webs (21, 22) on at least one side of each said part to be connected together, and in that the grooves (19, 20) and the webs (21, 22) guided in a form-fitting manner therein, of the parts which are to be connected, are coordinated with one another in contour such that, in the case of a pivoting operation of one of said parts to be connected through 180° about an axis (24) located between said parts to be connected and oriented parallel to the grooves (19, 20) and the webs (21, 22), said grooves and said webs being movable into a congruent position.

8. A stand system according to claim 7, characterized in that the webs (21, 22) of each said plug-in connection are provided with at least one braking or latching protrusion (25).

9. A stand system according to claim 2, characterized in that a front bottom border (16) of said at least one intermediate part (3) and ends of the side parts (1, 2) which are rearwardly offset relative to said front bottom border (16) of said at least one intermediate part (3) support said stand on an underlying surface (5).

10. A stand system according to claim 2, characterized in that said at least one intermediate part (3) is provided with means (5) for accommodating a projecting section of a rear wall (8) of said support (6).

11. A stand system according to claim 1, characterized in that a front bottom border (16) of said at least one intermediate part (3) and ends of the side parts (1, 2) which are rearwardly offset relative to said front bottom border (16) of said at least one intermediate part (3) support said stand on an underlying surface (5).

12. A stand system according to claim 11, characterized in that elastic supporting balls (4) are arranged at the ends of the side parts (1, 2) which are rearwardly offset relative to said front bottom border (16) of said at least one intermediate part (3).

13. A stand system according to claim 1, characterized in that said at least one intermediate part (3) is provided with means (5) for accommodating a projecting section of a rear wall (8) of said support (6).

14. A stand system according to claim 13, characterized in that the accommodating means (5) has a flat base (17).

15. A stand system according to claim 1, characterized in that the side parts (1, 2) and said at least one intermediate part (3) are designed as hollow plastic profiles.

16. A stand system according to claim 15, characterized in that the side parts (1, 2) are provided with weighting inserts.

17. A stand system according to claim 1, characterized in that said support (6) has a rear wall (9) with a slot (10) and a bore (11).

18. A stand system according to claim 1, characterized in that said support (6) is designed as an injection moulding with a shell body (7) having a central trough-shaped section (8).

19. A stand system according to claim 18, characterized in that the central trough-shaped section (8) of said support (6)

fits into said at least one intermediate part (3), and in that said support (6) is connectable to said at least one intermediate part by a screw (14).

20. A stand system according to claim 1, characterized in that said stand system comprises a plurality of said intermediate parts (3) connectable to each other by a plug-in connection provided by said connecting structure.

21. A stand system according to claim 20, characterized in that each of said side parts (1, 2) is connectable to a different one of said intermediate parts (3) by a plug-in connection provided by said connecting structure.

22. A stand system according to claim 1, characterized in that said at least one intermediate part (3) comprises at least one recessed groove (19, 20) and one web (21, 22) on said opposed sides thereof.

23. A stand system according to claim 22, characterized in that each of said side parts (1, 2) comprises at least one recessed groove (19, 20) and one web (21, 22) on only one side thereof.

24. A stand system according to claim 23, characterized in that said recessed groove (19, 20) and said web (21, 22) on said at least one intermediate part and on each of said side parts form part of a plug-in connection provided by said connecting structure.

25. A stand system according to claim 24, characterized in that said plug-in connection is provided with at least one braking or latching protrusion.

26. A stand system comprising a support and at least one swivel panel, swivel pocket, or swivel sleeve; said at least one swivel panel, swivel pocket, or swivel sleeve being removably and releasably mountable to said support for pivotable movement relative to said support, wherein the stand system further comprises two side parts (1, 2) and at least one intermediate part (3) disposed between said two side parts, said support being releasably connected to said at least one intermediate part.

27. A stand system comprising a support and at least one swivel element; said at least one swivel element being removably and releasably mountable to said support for movement relative to said support, wherein the stand system further comprises two side parts (1, 2) and at least one intermediate part (3), said at least one intermediate part (3) being releasably connected to said support (6), said at least one intermediate part (3) being disposed between said two parts (1, 2) and having opposed sides and a connecting structure on each of said opposed sides for selectively and releasably coupling said at least one intermediate part to at least one of said two side parts.

28. A stand system comprising a support and at least one swivel element; said at least one swivel element being removably and releasably mountable to said support for movement relative to said support, wherein the stand system further comprises two side parts (1, 2) and at least one intermediate part (3) disposed between said two side parts, said support being releasably connected to said at least one intermediate part.

* * * * *